United States Patent [19]

Sheahan

[11] 4,096,682

[45] Jun. 27, 1978

[54] BUNDLING OF CIGARETTES

[75] Inventor: Michael H. Sheahan, Toronto, Canada

[73] Assignee: Rothmans of Pall Mall Canada Limited, Toronto, Canada

[21] Appl. No.: 754,414

[22] Filed: Dec. 27, 1976

Related U.S. Application Data

[62] Division of Ser. No. 663,144, Mar. 2, 1976.

[51] Int. Cl.[2] ..... B65B 19/10

[52] U.S. Cl. ..... 53/149; 53/151

[58] Field of Search ..... 53/236, 151, 150, 149, 53/148

[56] References Cited

U.S. PATENT DOCUMENTS

| | | | |
|---|---|---|---|
| 1,247,364 | 11/1917 | Bracy | 53/149 X |
| 1,539,745 | 5/1925 | Kerlin et al. | 53/149 X |
| 1,601,257 | 9/1926 | Molins | 53/149 |
| 1,961,047 | 5/1934 | Horgan | 53/149 |
| 1,986,215 | 1/1935 | Orstrom | 53/149 X |
| 2,621,840 | 12/1952 | Kemp | 53/149 |

FOREIGN PATENT DOCUMENTS

| | | | |
|---|---|---|---|
| 583,696 | 12/1946 | United Kingdom | 53/151 |
| 370,684 | 4/1932 | United Kingdom | 53/149 |

*Primary Examiner*—Othell M. Simpson
*Assistant Examiner*—John Sipos
*Attorney, Agent, or Firm*—Sim & McBurney

[57] ABSTRACT

Nested three-row bundles of cigarettes are formed in rapid, simple and effective manner by forming a three-row group of cigarettes in which each row contains the same number of cigarettes, removing one cigarette from one end of the center row of cigarettes and displaying the remainder of the center row cigarettes towards the one end a sufficient distance to cause nesting.

10 Claims, 8 Drawing Figures

BUNDLING OF CIGARETTES

This is a division of application Ser. No. 663,144 filed Mar. 2, 1976.

FIELD OF INVENTION

The present invention relates to the bundling of cigarettes for formation into individual packages.

BACKGROUND TO THE INVENTION

In the formation of bundles of cigarettes containing three nested rows in which the centre row contains one less cigarette than the outer row for wrapping and later enclosure in a cigarette package, a variety of techniques have been used.

In one such technique, illustrated, for example, in U.S. Pat. Nos. 2,334,142 and 3,435,940, the rows are laid one on top of another in separate operations from individual hoppers, with the second hopper being designed to disperse one less cigarette than the other hoppers. This technique is combursome and uses bulky equipment.

Another technique, illustrated, for example, in U.S. Pat. Nos. 1,601,257, 1,961,047 and 2,621,840 forms a group of 3 rows of cigarettes in which the bottom row of cigarettes has one less than the remaining rows and then rearranges the cigarettes in the group to cause a cigarette from the middle row to move to the bottom row and to cause nesting of the cigarettes. These operations require complicated camming arrangements and can often lead to cigarette damage.

The present invention, in one aspect provides a simplified and reliable technique for formation of the nested group of cigarettes, including the formation of three rows of cigarettes containing the same number of cigarettes, the cigarettes being aligned vertically, removal of a cigarette from one end of the centre row and displacement of the remainder of the cigarettes in the centre row towards the one end to cause nesting of the cigarettes.

This simplified and reliable method of forming the group of three rows of cigarettes in nested arrangement may be used to advantage in the formation of a novel cigarette package, as described in pending U.S. Pat. application Ser. No. 693,186 field June 7, 1976.

As described therein, a cigarette package of 25 cigarettes is provided with a flip-top and the cigarettes are arranged in two bundles in the package, each bundle containing three nested rows of cigarettes and one less cigarette in the centre row than the outer rows. In one of the bundles, 14 cigarettes is provided while in the other 11 cigarettes is provided.

In the application of the present invention to the assembly of such a package, in accordance with a second aspect of the invention, there are simultaneously formed two groups of cigarettes each containing three rows of the same number cigarettes in vertical alignment, one of the groups containing fifteen cigarettes and the other twelve cigarettes. One cigarette is removed from the centre row of each group and the remainder of the cigarettes in each group is nested to provide two blocks of cigarettes, one containing fourteen cigarettes and the other eleven cigarettes, the removal of the cigarette and the nesting occurring simultaneously in the two groups.

After wrapping these blocks individually but simultaneously in foil paper or other conventional wrapping, the individual wrapped blocks are collated in side-abutting relationship and positioned on a cardboard blank from which the container may be formed, preferably a blank for a flip-top container. The package is formed by folding the blank around the collated blocks.

Appropriate apparatus for the implementation of these procedures also is provided by the present invention.

DESCRIPTION OF PREFERRED EMBODIMENTS

Figures 1, 2:
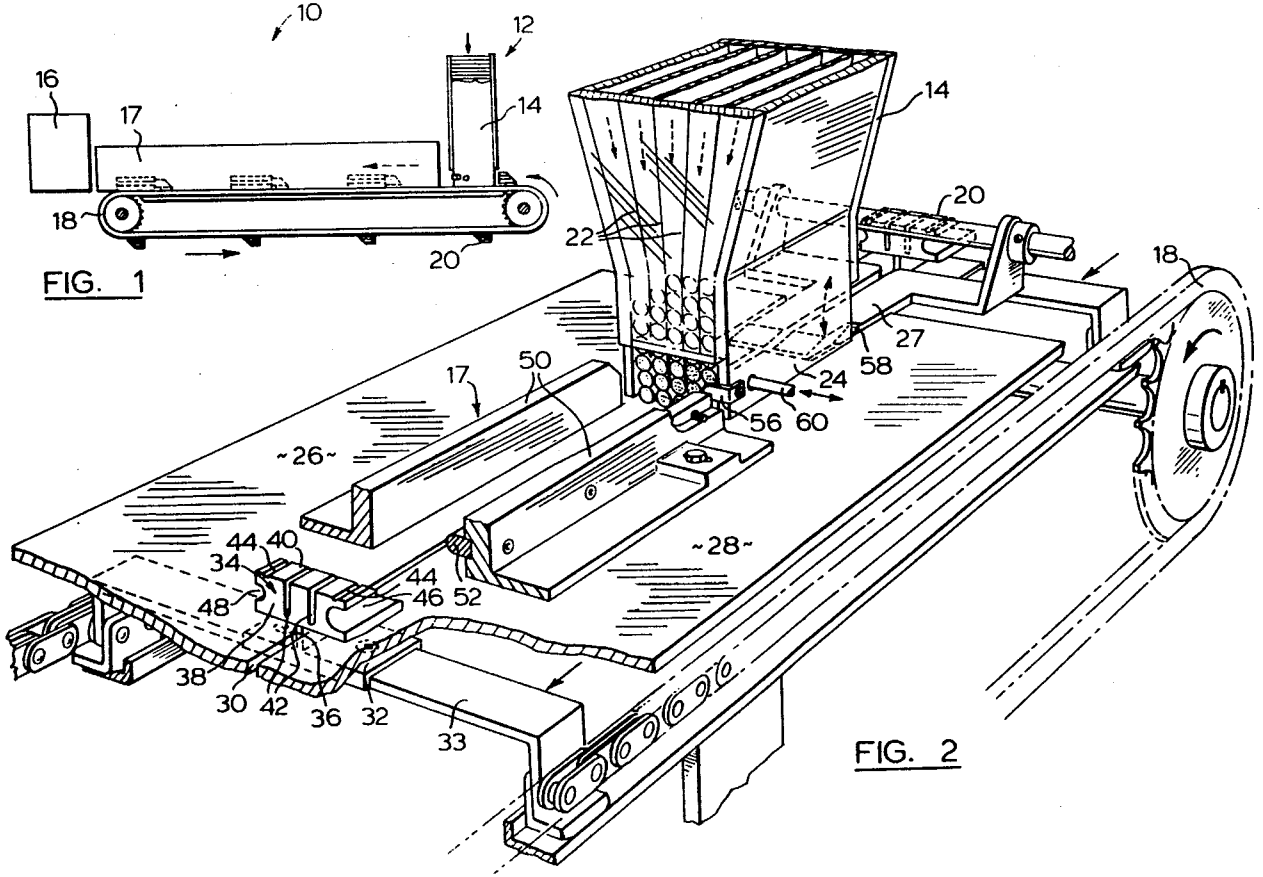
FIG. 1 is a side elevational view of an apparatus in accordance with one embodiment of the invention.
FIG. 2 is a detail generally perspective part sectional view of the hopper area of the apparatus of FIG. 1.

Referring to the drawings, a cigarette bundling apparatus 10 includes an assembly station 12, a hopper 14, a wrapping station 16, an elongate channel 17 extending between the assembly station 12 and the wrapping station 16, an endless conveyor belt 18 and a plurality of pusher elements 20 arranged to move a plurality of cigarettes from the assembly station to the wrapping station 16.

Figure 3:
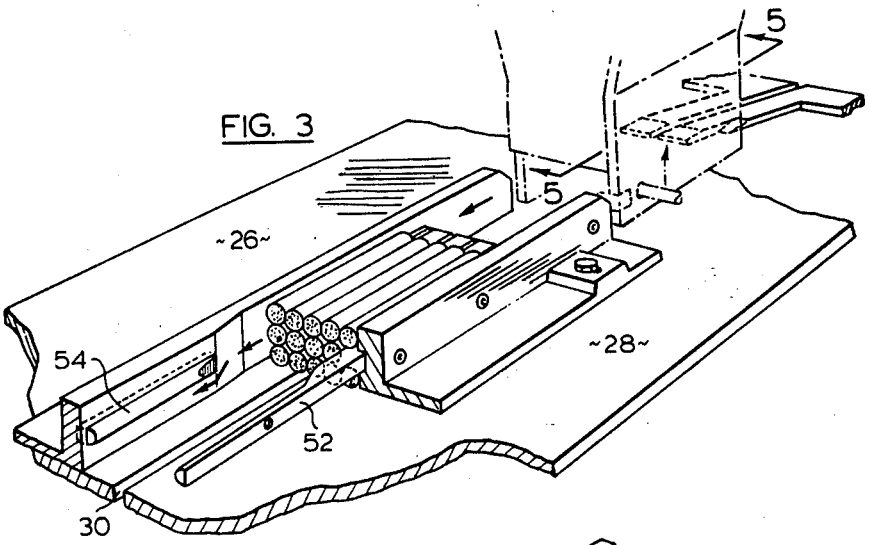
FIG. 3 is a further view of the hopper area.
Figure 4:
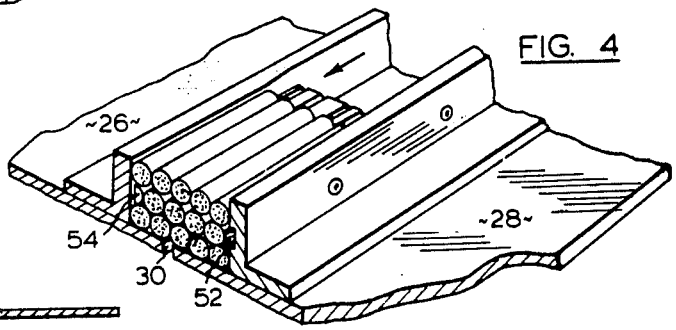
FIG. 4 is a detail of a portion of the conveyor of the apparatus of FIG. 1.
Figure 6:
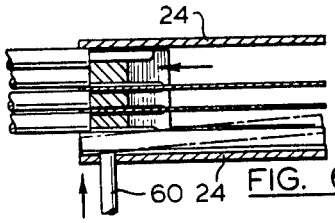
FIG. 6 is a section taken on line 6—6 of FIG. 5.
Figure 5:
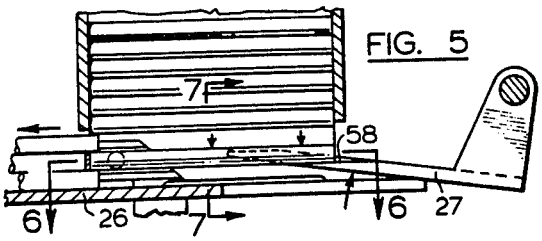
FIG. 5 is a section taken on line 5—5 of FIG. 3.

Cigarettes are fed from the hopper 14 to the assembly station 12 through a plurality of individual vertical parallel channels which are separated by vanes 22. The assembly station 12 includes laterally-confining side walls 24. At the base of the assembly station 12 is located a stationary platform 26 and a movable platform 27 pivoted for movement between a position coplanar with the stationary platform 26 and a position above the level of the platform 26, as seen from FIGS. 2, 3 and 5. The stationary platform 26 is an integral part of a base plate 28 of the apparatus.

With the movable platform 27 in its coplanar positions, cigarettes are positioned in the assembly station 12 in a plurality of rows each containing the same number of cigarettes.

The front and rear faces of the assembly station 12 are open to allow passage of the pusher element 20 therethrough. The base plate 28 has an elongate slot 30 extending from the assembly station 12 to the wrapping station 16 to allow for communication of the drive portion and driven portion of the pusher members 20 and movement of the pusher members 30 between the stations.

The pusher members 20 each include a base 32 which is secured to the endless conveyor 18 by cross members 33 and a head 34 joined to the base 32 by a web 36 which extends through the slot 30.

The head 34 has a planar cigarette-engaging front surface 38 and a sloping rear surface 40. Formed in the head 34 are vertical slots 42 extending downwardly from the upper surface of the head 34 to allow the head 34 to pass the centre two vanes 22 in the assembly station without fouling the same. Two grooves 44 also are provided in the upper surface of the head 34 to allow the head 34 to pass the outer two vanes 22 without fouling the same.

The head 34 has a recess or cutaway 46 formed at its right hand end (as seen in FIG. 2) extending generally perpendicularly at the front surface 38 and generally semi-circular in shape with a radius greater than a cigarette radius.

A second smaller recess 48 is formed at the left hand end of the head 34 also extending generally perpendicularly of the front surface 38. The second recess 48 is dimensioned to allow the head 34 to pass protrusions from the channel 17 corresponding to that side of the head 34 and described in more detail below. The head 34 of the pusher member 20 is dimensioned so that the front surface 38 engages three rows of cigarettes simultaneously for pushing such three rows out of the assembly station 12 and into the channel 17. The elongate channel 17 includes a bottom surface which is part of the base plate 28 and upright side walls 50.

The side walls 50 are spaced apart a distance substantially equal to the width of the group of cigarettes to be wrapped, except immediately adjacent the assembly station 12 where the width is slightly greater to allow for the less compact form of the group of cigarettes in the assembly station 12.

A first protrusion 52 is provided extending longitudinally from the assembly station 12 towards the wrapping station 16 a distance which is at least one cigarette length. The protrusion 52 is located on the wall 50 corresponding to the side on which is located the recess 46 in the head 34 of the pusher member 20.

The protrusion 52 is positioned and dimensioned to take the position of a cigarette of the center row of cigarettes. The protrusion 52 is tapered at its downstream end.

A second protrusion 54 extends from the other wall 50 and is tapered at its assembly station 12 end and extends in overlapping relationship with the first protrusion 52.

In operation, the planar surface 38 engages three rows of cigarettes positioned in the assembly station 12 and pushes the group of cigarettes out of the assembly station 12 and into the channel 17. The cigarette at the end of the centre row aligned with the recess 46, however, is not subjected to such pushing action and hence remains at the assembly station 12.

To discourage this cigarette from being drawn forward by the frictional forces of the neighbouring upper and lower cigarettes, a stop member or pin 56 typically is provided at the exit of the assembly station 12 in alignment with the cigarette 60 so that if there is a tendency for that cigarette to be carried forward it will be restrained by the stop member 62.

As the group of cigarettes is discharged from the assembly station 12, the first protrusion 52 occupies the space in a group of cigarettes vacated by the cigarette left behind at the assembly station to prevent the cigarette in the top row above the vacated space from falling down. The group of cigarettes is compacted by narrowing distance between the side walls 54 when it first leaves the assembly station 12.

When the second protrusion 54 engages the cigarette located at the other end of the middle row from the missing cigarette to displace that cigarette and hence the other cigarettes of the middle row sideways a distance equal to a one-half cigarette diameter, the cigarettes in the bundle move into a nesting arrangement. The displacement is possible since the first protrusion 52 tapers at its downstream end in its overlapping relationship with the protrusion 54.

The side walls 54 serve to prevent lateral displacement of the cigarettes in the other rows during the lateral displacement of the centre row of cigarettes. The resulting nested group of cigarettes in which the number of cigarettes in the middle row is one less than the number in the outer rows then is forwarded to the wrapping station 16.

The cigarette which is left at the assembly station 12 falls down to become the end cigarette of the bottom row of the next formed group of cigarettes discharged from the hopper through the vanes 22.

Figure 7:
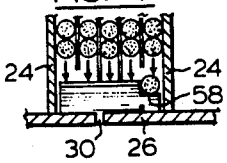
FIG. 7 is a section taken on line 7—7 of FIG. 5.

As the bundle passes beyond the movable platform 27, the platform 27 pivots upwardly and assists in guiding the left-behind cigarette to its position as may be seen from FIG. 7. A cut-away guide 58 assists in maintaining the cigarette in longitudinal alignment and guards against the cigarette falling cross-wise onto the platforms 26 and 27. A reciprocating pusher pin 60 also may be used to engage the forward end of the cigarette to correct its alignment. Other devices may be used to ensure the proper location of the left-behind cigarette.

While the operation and structure of the embodiment of the invention illustrated in FIGS. 1 to 7 is directed to the formation of a group of three rows of nested cigarettes containing 14 cigarettes, this particular number of cigarettes is chosen as the number of cigarettes to be included in one bundle of a two bundle - 25 cigarette pack formed in accordance with the second embodiment of the invention described in more detail below. The invention may be used to form a group of nested cigarettes containing any convenient number in three rows, including 5, 8, 11, 17 and 20 cigarettes.

20 cigarettes is a conventional number in such a bundle. It will be seen that the above-described apparatus and procedure provides a simplified and reliable manner of producing such conventional bundles.

Figure 8:
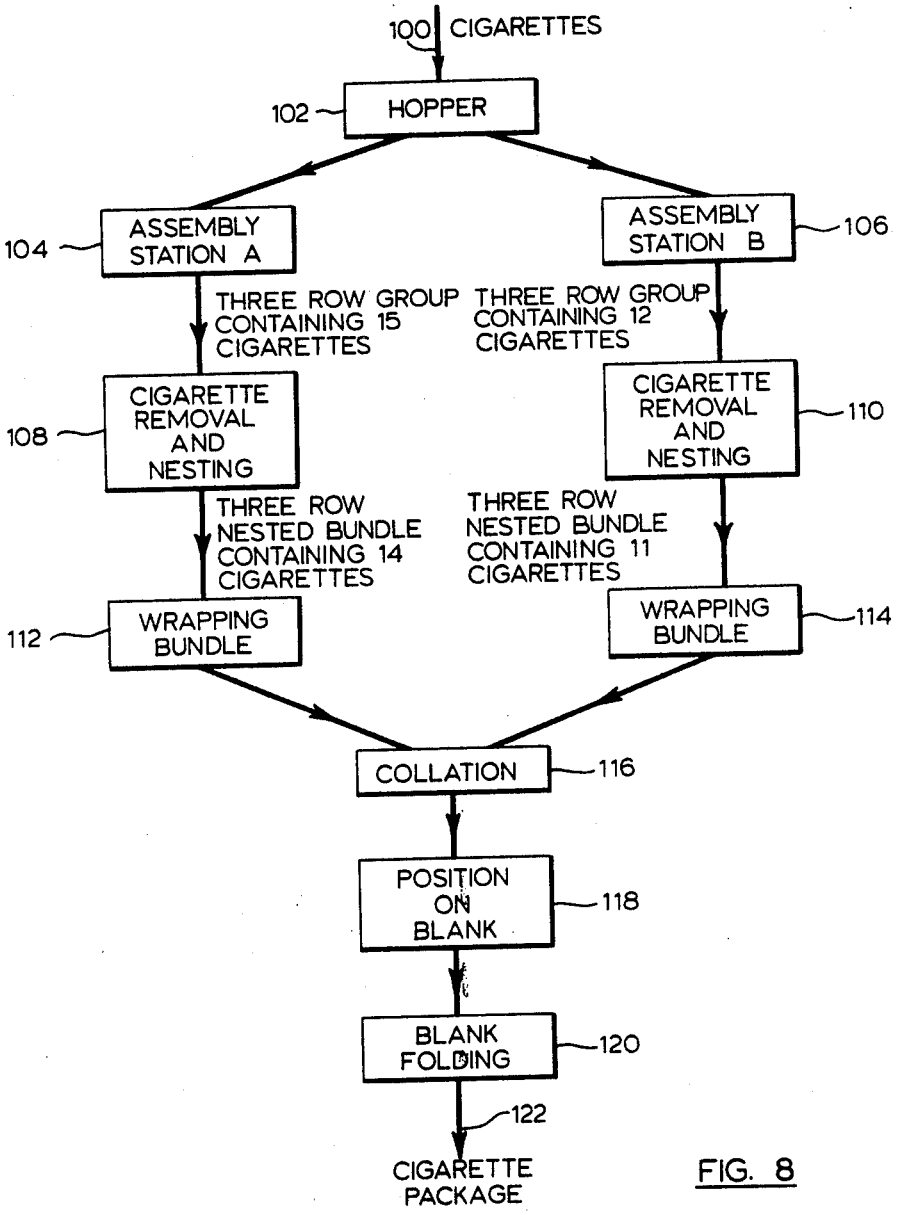
FIG. 8 is a schematic representation of a procedure for formation of a cigarette package.

Referring now to FIG. 8, cigarettes from any source are fed by line 100 to a hopper 102 designed to disperse cigarettes to two assembly stations 104 and 106. The assembly stations 104 and 106 are typically designed as shown in FIG. 2 to provide a group of three rows of cigarettes.

The assembly station 104 is designed to provide a group of fifteen cigarettes while assembly station 106 is designed to provide a group of twelve cigarettes. The assembly station 104 with its associated pusher may be as shown in FIGS. 1 to 7. While assembly station 106 is dimensioned to accommodate only four cigarettes in each row by the use of a single centre vane 22 and two outer vanes 22. The pusher 20 is proportionally dimensioned with only one slot 42 being provided in the head thereof.

The groups of cigarettes simultaneously formed in the assembly stations 104 and 106 then pass through cigarette removal and nesting 108 an 110 respectively, typically in equivalent manner to these operations as outlined above with respect to the apparatus of FIGS. 1 to 7.

The nested bundles of 14 and 11 cigarettes respectively then are passed to separate bundle wrapping operations 112 and 114 in which the bundles are wrapped in foil paper or other conventional wrapping to provide individual wrapped bundles.

The wrapped bundles are intended to provide a single package of 25 cigarettes of the type described above and outlined in pending U.S. Patent Application Ser. No. 693,186 filed June 7, 1976. The bundles typically are block-shaped having the same depth but different widths, owing to the three-row nested configuration of the cigarettes in each bundle and the different numbers of the cigarettes in the two blocks.

The bundles then are collated in side-abutting relationship at 116 followed by positioning of the collated bundles on a blank at 118, the blank being one from which the pack enclosure is to be formed. The blank is folded at 120 to provide the finished cigarette package which is removed by line 122. Blank positioning and folding operations are well known and require no description.

The blank preferably is one which folds to a "flip-top" type package. The embodiment of FIG. 7, therefore, illustrates the formation of the novel cigarette pack of the above-mentioned application by modification of conventional procedures and preferably using the nested bundle formation procedure of the invention.

SUMMARY

It will be seen, therefore, that the present invention provides an improved cigarette bundling procedure. Modifications are possible within the scope of the invention.

What we claim is:

1. Apparatus for the formation of a nested group of cigarettes consisting of three rows of cigarettes the central row of which contains one less cigarette than the other two rows, which comprises:

a hopper for dispensing downwardly cigarettes in parallel rows to an assembly station, a horizontal support platform at said assembly station to receive said dispensed rows of cigarettes thereon, an elongate channel extending from said assembly station towards a wrapping station for conveying a group of three rows of cigarettes therealong, said elongate channel comprising a generally flat bottom surface coplanar with said platform and parallel side walls upstanding from said bottom surface a distance at least equal to the depth of the group of cigarettes, said side walls being spaced apart the width of said group of cigarettes, a first elongate protrusion on one of said side walls extending longitudinally from said assembly station towards said wrapping station, said first protrusion being dimensioned so that its maximum vertical thickness is equal to the diameter of a cigarette of said group and it protrudes from said one wall towards said other wall a distance equal to the diameter of a cigarette in said group, adjacent said assembly station and for a distance therefrom at least equal to the length of a cigarette in said group, said first protrusion thereafter tapering longitudinally thereof to a dimension substantially equal to the radius of a cigarette in the group, said first protrusion having a lower surface spaced from said bottom surface a distance equal to the diameter of a cigarette in said group, a second elongate protrusion on the other of said walls extending longitudinally from a position part way along the length of said first protrusion towards said wrapping station and corresponding to the position along the length of said first protrusion of commencement of said tapering thereof, said second protrusion being dimensioned so that it protrudes from said other wall a distance increasing from its upstream end to a maximum dimension substantially equal to the radius of a cigarette in said group at its downstream end which coincides with the downstream end of said first protrusion, said second protrusion having a lower surface spaced from said bottom surface a distance at least the diameter of a cigarette in said group, said first and second protrusions cooperating to displace the centre row of cigarettes in a group a distance equal to the radius of a cigarette in that row during movement of said group along said channel past said protrusions, and pusher means for pushing said group of cigarettes longitudinally thereof out of said assembly station and along said channel towards said wrapping station, said pusher means comprising a substantially vertical cigarette group-engaging surface, said surface having an opening at one side thereof corresponding to said one wall and dimensioned to allow the passage of a cigarette therethrough, said surface being positioned to engage all the cigarettes in said group with the exception of the one cigarette on the centre row at the end of said row corresponding to said one side of said surface, whereby, when said pusher moves said group of cigarettes out of said assembly station said one cigarette remains in said assembly station as the opening in said surface by-passes said one cigarette.

2. The apparatus of claim 1 wherein said hopper includes a plurality of vertical vane members separating the cigarettes of said rows from each other during dispensing.

3. The apparatus of claim 1 including stop means located at the exit from said assembly station in alignment with said one cigarette to inhibit longitudinally movement of said one cigarette.

4. The apparatus of claim 1 wherein said side walls are spaced apart a greater distance immediately adjacent said assembly station than elsewhere along the length of said channel.

5. The apparatus of claim 1 including a drive conveyor extending from said assembly station to said wrapping station, a plurality of said pusher means mounted on said conveyor means at spaced locations therealong for successive engagement of blocks of cigarettes in said assembly station and movement thereof along said channel to said wrapping station.

6. The apparatus of claim 5 including an elongate opening formed in each of said platform and said bottom surface of said channel, and wherein said drive conveyor is located below said platform and said surface and each of said pusher means comprises a base member mounted on said drive conveyor, a head member including said vertical surface extending generally transverse of said head member, and a vertical web member integrally joining said base and head members and adapted to extending through said elongate opening during movement of said pusher means from said assembly station to said wrapping station.

7. The apparatus of claim 6 wherein said head member and includes a semi-circular recess at said one side perpendicular to said surface, and a recess at the other side to allow passage of said head past said second protrusion without engaging the same.

8. The apparatus of claim 6 wherein said hopper includes a plurality of vertical vane members separating the cigarettes of said rows from each other during dispensing, and said head member includes vertical slots therein in locations corresponding to said vanes and arranged to avoid engagement between said head member and said vanes during passage of the head member through said assembly station.

9. The apparatus of claim 1 wherein said horizontal support platform at said assembly station comprises a first stationary platform portion and a second movable platform portion mounted for pivotal movement about an axis transverse to the platform between a first position coplanar with said stationary platform portion and a second position above the level of the stationary platform portion; said movable platform portion being positioned coplanarly with said stationary platform portion when said dispensed rows of cigarettes are located at said assembly station for ejection therefrom by said pusher means and being pivoted upwardly when said pusher means has moved out of said assembly station to assist in guiding the cigarette left behind in said assembly station into position on said platform upon return of the movable platform portion to said coplanar position with said stationary platform portion.

10. The apparatus of claim 9 including positioning means for ensuring longitudinal alignment of the left behind cigarette at the assembly station.

* * * * *